US006157399A

United States Patent [19]

Miyaji et al.

[11] Patent Number: 6,157,399

[45] Date of Patent: Dec. 5, 2000

[54] COLOR IMAGE RECORDING APPARATUS

[75] Inventors: Noboru Miyaji, Hirakata; Yoichi Sekine, Utsunomiya; Toshiaki Nakata, Izumi; Yasutaka Tamai, Moriguchi; Koji Ohi, Minou; Yoshiya Igashima, Katano; Yoshitaka Kitaoka, Osaka, all of Japan

[73] Assignee: Matsushita Electric Industrial Co., Ltd., Osaka, Japan

[21] Appl. No.: 09/102,682

[22] Filed: Jun. 23, 1998

Related U.S. Application Data

[62] Division of application No. 08/391,040, Feb. 21, 1995, abandoned.

[30] Foreign Application Priority Data

| | | | |
|---|---|---|---|
| Feb. 22, 1994 | [JP] | Japan | 6-23924 |
| Feb. 22, 1994 | [JP] | Japan | 6-23925 |
| Feb. 22, 1994 | [JP] | Japan | 6-23939 |
| Feb. 23, 1994 | [JP] | Japan | 6-25166 |

[51] Int. Cl.[7] ..... B41J 2/325

[52] U.S. Cl. ..... 347/213

[58] Field of Search ..... 347/213, 216, 347/176, 172, 174; 400/120.01, 120.02

[56] References Cited

U.S. PATENT DOCUMENTS 4,923,848 5/1990 Akada et al. .

5,532,724 7/1996 Inagaki et al. .

FOREIGN PATENT DOCUMENTS 2-238985 9/1990 Japan .

4-327981 11/1992 Japan .

*Primary Examiner*—Huan Tran

*Attorney, Agent, or Firm*—Ratner & Prestia

[57] ABSTRACT

This invention relates to a color image recording apparatus, which once records an image on an intermediate sheet by means of a recording means, and then transcribe the recorded image on any desired recording sheet. Where, in the step of recording on the dye depositing layer of intermediate sheet, the color image is recorded for a length longer than that the sheet holding body can hold the intermediate sheet at one time by repeating the process cycle of multi color-recording with the intermediate sheet held sticking fast on the sheet holding body and releasing of the intermediate sheet from the tight holding; and then the dye depositing layer carrying the recorded image is transcribed on any desired recording sheet.

In doing this way, snaking motion and slipping of the intermediate sheet are prevented, heat shrinkage of the intermediate sheet is curtailed to produce a quality color image having precise alignment of color positioning on any desired recording sheet.

8 Claims, 8 Drawing Sheets

COLOR IMAGE RECORDING APPARATUS

This application is a division of U.S. patent application Ser. No. 08/391,040, filed Feb. 21, 1995, now abandoned.

The entire disclosure of U.S. patent application Ser. No. 08/391,040 filed Feb. 21, 1995 is expressly incorporated by reference herein.

FIELD OF THE INVENTION

This invention relates to a color image recording apparatus which records with ink materials containing at least coloring stuffs on a recording sheet such as plain paper.

BACKGROUND OF THE INVENTION

In conventional thermal transcription recording methods, using melting-type thermal transcription ink sheet wherein pigment is employed as coloring stuff, or sublimation-type thermal transcription ink sheet wherein thermal diffusion dyestuff is employed as coloring stuff, an image is formed direct on a recording sheet by a recording head through the ink sheet overlaid on the recording sheet. Also, such other method is known, where, in order to obtain a quality image irrespective of the kind of recording sheet (surface material, surface condition), an image is once formed on an intermediate sheet by any desired method, including thermal transcription, and then the image on intermediate sheet is transcribed on a recording sheet as the ultimate image.

An example of thermal transcription recording method/apparatus using an intermediate sheet is the one which is laid open by the gazette of Japanese Patent Application Toku•Kai•Hei 4-327981. In the following, constitution of this method is explained, referring to FIG. 15.

FIG. 15 shows the outline constitution of a thermal transcription recording apparatus. Where, the intermediate sheet 301 is made of a heat resisting first substrate 302 and a dye depositing layer 303. Ink sheet 304 is made, likewise, of a heat resisting second substrate 305 and an ink material layer 306.

The intermediate sheet 301 and ink sheet 304 are placed, being pressed together, between platen 307 and thermal head 308, which selectively generates heat in response to a recording signal to transcribe at least part of coloring stuff contained in the ink material layer 306 onto the surface of dye depositing layer 303 of intermediate sheet 301; an image is thus recorded on the intermediate sheet 301. The image-bearing intermediate sheet 301 is carried forward to the direction of 309 by revolution of the platen 307. Ink sheet 304 is rolled up by ink sheet roll up roller 310.

In recording a color image, the platen 307 is reversed upon completion of the recording with a first color to bring the intermediate sheet 301 back to the starting position to be ready for recording with a second color. During the reversing operation, the thermal head 308 and ink sheet 304 are held off the intermediate sheet 301. For the second color recording, they are reset together to make contact with a pressure, and recording is conducted in the same manner as in the first color. By the same procedure, image with a third color (being the final color) is recorded.

Next step is to overlay the intermediate sheet 301 on recording sheet 311 to be press-held between heating roller 312 and roller 313. Then the intermediate sheet 301 is heated with the heating roller 312, the dye depositing layer 303 softens, and part of it diffuses into the surface of the recording sheet 311. By means of separation roller 314 and roller 315, the first substrate sheet 302 is made to go straight forward, while the recording sheet 311 is bent; by this way, the dye depositing layer 303 is transcribed on the recording sheet 311. And then, the recording sheet 311 carrying the dye depositing layer 303 over it goes through pressure roller 316 and roller 317 to have the recorded image fixed.

Thus, in the thermal transcription recording using the intermediate sheet 301, melting type thermal transcription method needs an intermediate sheet 301 having a dye depositing layer 303 into which coloring stuff fuses; or, sublimation type thermal transcription method needs an intermdeiate sheet 301 having a dye depositing layer 303 to which dyestuff adheres. Formation of an image on the recording sheet 311 is conducted by once forming the image on the dye depositing layer 303 of intermediate sheet 301, and then transcribing the image onto the recording sheet 311 by overlaying the dye depositing layer 303 carrying the image on the recording sheet 311; then, the recording sheet 311 having the dye depositing layer 303 affixed on it is separated from the first substrate 302 of the intermediate sheet 301; afterwards, a fixing process follows depending on needs.

When forming a color image consisting of plurality of color elements in such conventional process constitution, an image has to be recorded on the dye depositing layer 303 of intermediate sheet 301 for each color, superpositioning second and third colors on the image of first color. Images of the second color and after need to be exactly aligned on the first image. Inaccurate aligning results in the poor color reproduction, blurred images and other drawbacks. Furthermore, in the conventional method, if relative speed between the ink sheet 304 and the intermediate sheet is not kept constant, various inconveniences such as uneven recording density and broken ink sheet arise.

The intermediate sheet 301 in the conventional constitution is transferred by a friction driving force of platen 307 and a friction between the ink material layer of the ink sheet 304 and the dye depositing layer 303 of intermediate sheet 301. On the other hand, the ink sheet 304 is driven by a pulling force of the ink sheet roll up roller 310, and a friction between the ink material layer 306 of ink sheet 304 and the dye depositing layer 303 of intermediate sheet 301; also, the back tension by ink dispenser roller (not illustrated) and the brake force caused by a friction between the thermal head 308 and back surface of the ink sheet 304 are effected. The ink sheet 304 and the intermediate sheet 301 are transferred by virture of a subtle balancing among these forces, maintaining an appropriate tension. Dependence of the transfer of intermediate sheet 301 and ink sheet 304, being most important elements, on the friction coefficient, which is easily influenced by temperature/moisture, has been making it difficult to secure a stable transfer of these sheets.

The color image recording apparatus by means of thermal transcription uses an ink sheet on which ink materials of three colors, viz. yellow, magenta and cyanine, plus black, making four colors, are provided sequentially in one space after another, and transcribes the ink sheet sequentially on a recording sheet, or on an intermediate sheet, to form a color image. On the ink sheet and coatings of each of the color ink materials provided sequentially over the full space to comply with the largest size of recording sheet. Consequently, when the size of recording sheet is small, part of the ink is left unused, rendering the utilization rate of ink sheet low.

In a method where an intermediate sheet having a dye depositing layer, the size of which is adapted to fit for the size of recording sheet, is used, the intermediate sheet needs to be replaced each time when the size of recording sheet is changed; the work efficiency is affected.

In another case, where an intermediate sheet on which the dye depositing layer is provided to comply with the largest size recording sheet, or an intermediate sheet on which the dye depositing layer is provided over the entire surface is used, and the dye depositing layer having an image is transcribed on a recording sheet of any desired size, and then separate the recording sheet having the transcribed dye depositing layer with it from the substrate sheet of intermediate sheet, when the size of recording sheet is larger than the intermediate sheet the cutting performance of dye depositing layer at the front and the rear ends of the recording sheet is poor, when the size of recording sheet is smaller than the intermediate sheet the cutting performance not only at the front and rear, but also at both sides turns out to be poor, causing difficulty in separation of the recording sheet, and other problems.

SUMMARY OF THE INVENTION

The objective of this invention is to stabilize the transfer of an intermediate sheet and an ink sheet, in the heat transcription recording system using an intermediate sheet; thereby preventing the occurence of broken sheet and uneven recording density to implement a new color image recording apparatus which produces on any desired recording sheet a quality color image having precise alignment of color superposition.

Another objective of this invention is to offer a new color image recording apparatus which produces a quality color image in a smaller machine setup, reducing redundant use of intermediate sheet and ink sheet; because the apparatus according to this invention consumes the intermediate sheet corresponding to the size of recording sheet, or consumes the ink sheet corresponding to the size of an image to be recorded.

This invention comprises an intermediate sheet which is made up of a continuous substrate sheet having a transparent dye depositing layer on one of the surfaces, a means to hold the other surface of said intermediate sheet stuck fast to a sheet holding body, an ink sheet having coloring material layer containing dyestuff or pigment, a recording means to selectively record the ink material on said dye depositing layer with said dye depositing layer sticking fast to ink material layer of ink sheet, a means to transcribe the ink material recorded in said dye depositing layer, together with the layer, on to said recording sheet while holding the surface of said intermediate sheet having the recorded ink material stuck fast to the recording sheet, and a means to separate, after the transcription is completed, the dye depositing layer from the substrate of intermediate sheet; thereby, produces a precisely color-aligned quality color image on any desired recording sheet by repeating, in said recording process step to dye depositing layer of intermediate sheet, the multi color-recording operation under the tight sticking of said intermediate sheet to the sheet holding body kept as it is and releasing of said intermediate sheet from the tightly stuck condition to obtain a color image longer than the length the sheet holding body can hold said intermediate sheet at one time, which makes it possible to record a color image holding the intermediate sheet stuck fast to the sheet holding body, hence intrusion of the air between the sheet holding body and the intermediate sheet is prevented conserving the tight adherence of intermediate sheet to sheet holding body, because as a result, the snaking motion of the intermediate sheet and slipping of the intermediate sheet relative to the sheet holding body do not occur, also thermal shrinkage of the intermediate sheet may be curtailed. In this way, the ink sheet is consumed by small block units, so the loss of ink sheet can be minimized.

DESCRIPTION OF THE PREFERRED EMBODIMENTS

Figure 1:
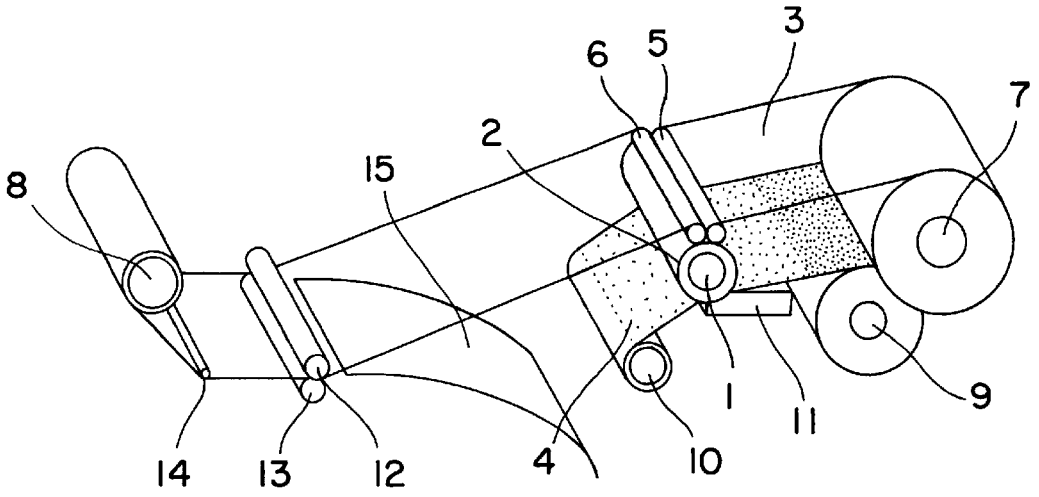
FIG. 1 is perspective view showing the outline constitution of a color image recording apparatus according to Embodiment 1 of this invention.

Embodiment 1 of this invention is herewith described referring to FIG. 1. FIG. 1 is perspective view showing the outline constitution of a color image recording apparatus according to Embodiment 1 of this invention.

As shown in the FIG., sheet holding drum 1 is covered with rubber layer 2 of silicone group, etc. which has sticky surface, and is 30 mm diameter. Intermediate sheet 3 is a continuous resin film sheet which has on its surface to be facing ink sheet 4 a separable dye depositing layer. On the surface of ink sheet 4 facing intermediate sheet 3 are coated with coloring material layers made of dyestuff (or pigment) and binder resin, in the sequence of yellow layer, followed by magenta and cyanine layers, each 50 mm plus long. The surface of intermediate sheet 3 having no dye depositing layer is held sticking to the surface of sheet holding drum 1 by the effects of stickiness of the surface of the sheet holding drum 1 and the pressure of sheet holding means 5, 6 (for adhesion of entire surface). The sheet holding means 5, 6 hold the intermediate sheet 3 sticking and fixed around the sheet holding drum 1 during the recording process step, and are designed to move together with the sheet holding drum 1 as a unitized gear. Each of intermediate sheet feeding roller 7 and intermediate sheet roll up roller 8 revolves to the direction to roll up the intermediate sheet 3. As the roll up force is adjusted by a torque limiter (not illustrated), the intermediate sheet 3 is always stretched tight. The sheet holding drum 1 is installed by an axis (not illustrated) which enables the intermediate sheet feeding roller 7 to revolve, and is designed to be able to get set and off to comply with recording position. Ink sheet feeding roller 9 supplies the ink sheet 4, ink sheet roll up roller 10 rolls up the ink sheet 4. Recording head (recording means) 11 is installed so as to be able to touch on and off the sheet holding drum 1 placed at the recording position, and is equipped with a thermal head of 12 dot/mm. There are heating roller 12 and pressure roller 13 as the transcription means, and separation roller 14 as the separation means.

With the above mentioned constitution, the recording operation is described below.

The sheet holding drum 1 holds the intermediate sheet 3 with the aid of sheet holding means 5, 6, and revolves anti-clock wise to be set at the starting position for recording while keeping the tight sticking to the sheet holding drum 1. Then, the sheet holding drum 1 starts revolving clock wise for the recording of first color. At this time, the surface of coloring material layer of ink sheet 4 is pushed up by the recording head 11 to touch the dye depositing layer of intermediate sheet 3. The ink sheet 4 is transferred along with the rotation of sheet holding drum while accepting the thermal pulse from the rear surface generated by the recording head 11 in response to recording signal; in this way, the first color (yellow) image is recorded on the dye depositing layer of intermediate sheet 3 for the length of 50 mm.

And then, the sheet holding drum 1, while holding the intermediate sheet 3 with the holding means 5, 6 as it is, is driven anti-clock wise to be restored to the starting position for recording with the second color (magenta). During the reversing, the ink sheet 4 and recording head 11 are set off the intermediate sheet 3; and positioned again to touch on for recording with the second color, the image with second color is recorded in the same manner as in the first color. The third color (cyanine) is likewise recorded to obtain a mirror-reflected image in color on the intermediate sheet for the length of 50 mm.

The sheet holding means 5, 6 are then set at a specified position and released from the unitization with the sheet holding drum 1 ceasing the unitized motion with the sheet holding drum 1; and the sheet holding means 5, 6 themselves start revolving in line with the rotation of sheet holding drum 1. The sheet holding drum rotates clock wise to transfer the color image formed on the intermediate sheet 3 forward by 50 mm. Next, the sheet holding means 5, 6 are again set to the sheet holding drum 1, and the recording is conducted for the length of 50 mm in the sequence of yellow, magenta and cyanine. By repeating the process cycles until the end of an image is reached, a color image of a length longer than that of the intermediate sheet 3 which is held at one time around the sheet holding drum 1 is produced.

After the above operation, the sheet holding means 5, 6 are set at a specified position and are released from the unitization with the sheet holding drum 1; the sheet holding drum 1 revolves clock wise to transfer the intermediate sheet 3, which carries a color image recorded on its dye depositing layer, forward. Meanwhile, the intermediate sheet 3 drawn out of the intermediate sheet feeding roller 7 is pressed to the surface of sheet holding drum 1 by the sheet holding means 5 to have the intermediate sheet 3 stuck; in this way, preparation for the next recording is conducted simultaneously. The intermediate sheet 3 carrying a recorded image leaves the sheet holding drum 1 and sheet holding means 6, and is sent out for the transcription process.

The intermediate sheet 3 and the recording sheet 15, with the former's dye depositing layer sticking to the latter, are forwarded to go through the heating roller 12 and pressure roller 13, both constitute the transcription means, to be heat•pressed together; and the dye depositing layer of intermediate sheet is glued on to the recording sheet. The intermediate sheet 3 and the recording sheet 15 thus glued together by molten dye depositing layer are cooled down below a specific temperature, e.g. below glass transition point of the dye depositing layer of intermediate sheet 3, and then separated into two, viz. the recording sheet having the dye depositing layer glued on it and the substrate of intermediate sheet 3. The dye depositing layer and ink material recorded in it are transcribed to the recording sheet, the gluing power of which is stronger. The smoothness of surface of a color image sheet thus produced almost equals to the condition of peeled-off surface of substrate of intermediate sheet 3; the surface of substrate of intermediate sheet is highly smooth, and a glossy color image sheet is produced.

As described above, Embodiment 1 comprises the intermediate sheet 3 made of a continuous substrate sheet having a transparent dye depositing layer on one of the surfaces; the sheet holding means 5, 6 intended to hold the other surface of said intermediate sheet 3 stuck to the sheet holding drum; the ink sheet 4 having coloring material layers containing dyestuff or pigment; the recording head 11 which selectively records the ink material on said dye depositing layer of intermediate sheet 3 while maintaining the tight adhesion of intermediate sheet 3 to sheet holding drum 1; the heating roller 12 and pressure roller 13 intended to transcribe the ink material recorded in said intermediate sheet 3, together with said dye depositing layer of intermediate sheet 3, on to said recording sheet 15 keeping the surface of said intermediate sheet 3 having the ink material recorded sticking to the recording sheet 15; and the separation roller 14 intended to separate the dye depositing layer from the substrate of said intermediate sheet 3; and, in the recording process on to the dye depositing layer of said intermediate sheet 3, produces a color image on the intermediate sheet for a length longer than that which said sheet holding drum 1 can hold around it at one time, by repeating the process cycle of multi color-recording with the intermediate sheet 3 stuck fast around the sheet holding drum 1 and releasing of said intermediate sheet 3 from the sticking condition, thereby a color image is recorded while the intermediate sheet is kept stuck fast to the sheet holding drum 1, by so doing, intrusion of the air between the sheet holding drum 1 and the intermediate sheet 3 is prevented, the intermediate sheet 3 can be maintained sticking fast around the sheet holding drum 1, snaking motion of the intermediate sheet 3 and slipping of the intermediate sheet 3 relative to the sheet holding drum do not occur, thermal shrinkage of the intermediate sheet 3 can also be curtailed; therefore, can provide a precisely color-aligned quality color image on any desired recording sheet 15. The ink sheet 4 is consumed at a smaller unit, which contributes to minimizing the redundant use of ink sheet 4.

Figure 2:
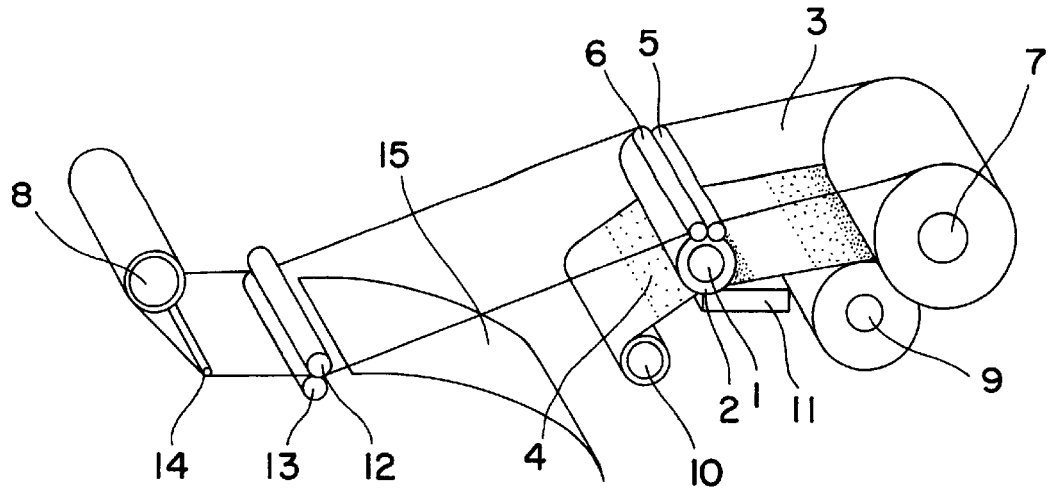
FIG. 2 is perspective view showing the outline constitution of a color image recording apparatus according to Embodiment 2 of this invention.

Embodiment 2 of this invention is now described herewith referring to FIG. 2. The constituent parts of the same function as in the above Embodiment 1 are given with the same reference numerals, and explanation to which is omitted.

FIG. 2 is perspective view of the outline constitution of a color image recording apparatus according to Embodiment 2 of this invention.

As shown in the FIG., on the surface to face the intermediate sheet 3 of ink sheet 4 are layers of coloring material made from dyestuff (or pigment) and binder resin, positioned in the sequence of yellow coloring material layer, magenta coloring material layer and cyanine coloring material layer, each 25 mm plus long. The sheet holding means 5, 6 are, during recording process, set to the main body, revolvable freely following the revolution of sheet holding drum 1. The length of intermediate sheet being pressed by the sheet holding means 5, 6 and stuck fast to the sheet holding drum is 60 mm. Recording head 11 positioned so that the heating element touches the intermediate sheet at about the middle of its holding length.

Under the above mentioned setup, the recording operation is explained in the following.

The sheet holding drum 1 starts its revolution clock wise for recording with the first color, when, the surface of coloring material layer of ink sheet 4 is pushed up by the recording head 11 to touch the dye depositing layer of intermediate sheet 3. The ink sheet 4 is transferred along with the revolution of sheet holding drum 1 while receiving from the rear surface a thermal pulse generated by the recording head 11 according to recording signal reached; in this way an image with the first color (yellow) is recorded on the dye depositing layer of intermediate sheet for 25 mm long. The length of recorded image is less than half the intermediate sheet holding length, therefore, the front edge of yellow image is still retained within the holding by sheet holding drum 1.

Next, the sheet holding drum 1 is reversed anti-clock wise to the starting position for recording with the second color (magenta). The rear end of yellow image is still held within the holding by the sheet holding drum 1. During the reversing, the ink sheet 4 and recording head 11 are standing by keeping off the intermediate sheet 3; at the start of recording with the second color they are reset to press•touch, and the second color recording is conducted in the same way as in the first color. Likewise, the third color (cyanine) image is recorded to obtain a mirror-reflected color image on the intermediate sheet 3 for 25 mm long.

The sheet holding drum 1 revolves clock wise to transfer the color image formed on the intermediate sheet 3 by the length of 25 mm. And then, recording by 25 mm long in the sequence of yellow, magenta and cyanine is conducted again. By repeating the above mentioned process cycle until the end of an image to be recorded, a color image, length of which is longer than that the sheet holding drum 1 holds the intermediate sheet 3 at one time, is produced.

Afterwards, the sheet holding drum 1 revolves clock wise to transfer the intermediate sheet 3 having color image in its dye depositing layer to the transcription means. Meanwhile, the intermediate sheet 3 drawn from the intermediate sheet dispenser roller 7 is pressed by the sheet holding means 5 to the surface of sheet holding drum to be stuck on it, thus, preparation for the next recording is done simultaneously.

The intermediate sheet 3 and the recording sheet 15, with the former's dye depositing layer sticking to the latter, are forwarded to go through the heating roller 12 and pressure roller, both constitute the transcription means, to be heat•pressed together; and the dye depositing layer of intermediate sheet is glued on to the recording sheet. The intermediate sheet 3 and the recording sheet thus glued together by molten dye depositing layer are cooled down below a specific temperature, e.g. below glass transition point of the dye depositing layer of intermediate sheet 3, and then separated into two, viz. the recording sheet having the dye depositing layer glued on it and the substrate of intermediate sheet 3. The dye depositing layer and ink material recorded in it are transcribed to the recording sheet, the gluing power of which is stronger. The smoothness of surface of a color image sheet thus produced almost equals to the condition of peeled-off surface of substrate of intermediate sheet 3; the surface of substrate of intermediate sheet is highly smooth, and a glossy color image sheet is produced.

As described above, Embodiment 2, in the recording process on to the dye depositing layer of intermediate layer 3, produces a color image on the intermediate sheet for a length longer than that which the sheet holding drum 1 can hold around it at one time, by repeating the process cycle of multi color-recording with the intermediate sheet 3 stuck fast around the sheet holding drum 1 for the length less than half that which the sheet holding drum can hold at one time and releasing of intermediate sheet 3 from the sticking condition, thereby a color image is recorded while the intermediate sheet is kept stuck fast to the sheet holding drum 1, by so doing, snaking motion of the intermediate sheet 3 and slipping of the intermediate sheet 3 relative to the sheet holding drum do not occur, thermal shrinkage of the intermediate sheet 3 can also be curtailed; therefore, can provide a precisely color-aligned quality color image on any desired recording sheet 15. The ink sheet 4 is consumed at a smaller unit, which contributes to minimizing the redundant use of ink sheet 4. The motion of sheet holding means 5, 6 is simplified, which contributes to reduce the number of components, to simplify the constitution, and to make the apparatus compact and cheaper.

Embodiment 3 of this invention is described in the following, referring to FIG. 3. The constituent parts of the same function as in the above Embodiment 1 are given with the same reference numerals, and explanation to which is omitted.

Figure 3:
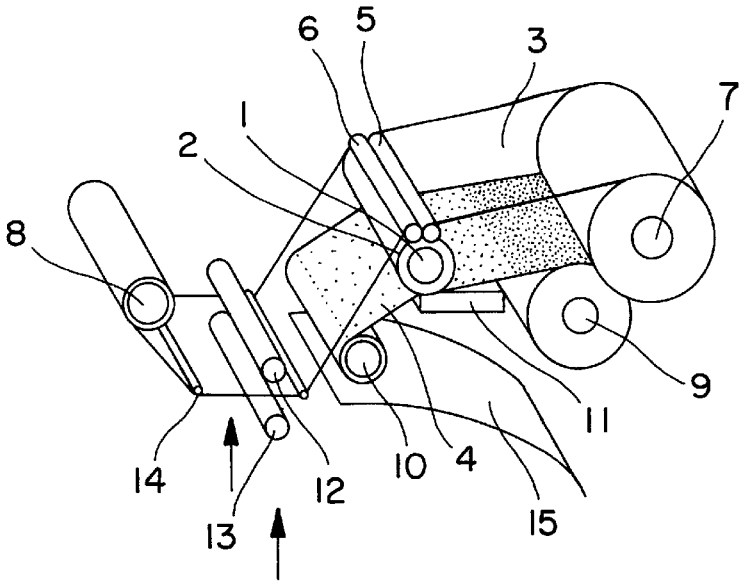
FIG. 3 is perspective view showing the outline constitution of a color image recording apparatus according to Embodiment 3 of this invention.

FIG. 3 is perspective view showing the outline constitution of a color image recording apparatus according to Embodiment 3 of this invention.

As shown in the FIG., the intermediate sheet 3 is a continuous resin film sheet, on which surface facing the ink sheet 4 is a separable dye depositing layer. The intermediate sheet 3 is held stuck fast to the surface of sheet holding drum 1 by the effects of stickiness of the surface of the sheet holding drum 1 and the pressure of sheet holding means 5, 6, with the surface having no dye depositing layer touching the drum surface. The distance between sheet holding drum 1 and heating roller 12/pressure roller 13, being the transcription means is made shorter than the case of Embodiment 1, and during the recording operation the transcription means, viz. heating roller 12 and pressure roller 13, are positioned open so as not to touch the intermediate sheet 3.

Under the above mentioned constitution, the recording operation is now described. The basic operation remains the same as in Embodiment 1 or Embodiment 2; therefore, only those different from them are explained hereunder.

When the longest possible image is produced on a color image recording apparatus of this Embodiment, the front edge should go beyond the transcription means, reaching the intermediate sheet roll up roller 8 side. The heating roller 12 and pressure roller 13, being the transcription means, are kept open, and are not in touch with the intermediate sheet 3. Therefore, even if a large size image is recorded and a part of the image recorded on the intermediate sheet 3 is forwarded to the transcription means while the recording operation is going on, the intermediate sheet 3 might not be deformed by the heat of transcription means, or the image quality might not be injured by the touch with pressure roller 13.

As soon as the recording operation is completed upto the end of the image, the intermediate sheet 3 is once retrieved to the intermediate sheet dispenser roll 7 side by revolving the sheet holding drum 1 anti-clock wise. After the front edge of the recorded image is set to the right position the pressure roller 13 is pushed up to the direction of arrow to have contact with the heating roller 12. The intermediate sheet 3 and the recording sheet 15 are press-heated by the heating roller 12 and pressure roller 13, and the dye depositing layer of intermediate sheet 3 melts to be glued on to the recording sheet 15. Then, by means of the separation roller, the dye depositing layer of intermediate sheet 3 is transcribed on the recording sheet 15.

As described above, according to Embodiment 3, where, in its recording process on to the dye depositing layer of intermediate sheet 3, a color image, the size of which is longer than that the sheet holding drum 1 can hold the intermediate sheet at one time, is produced by repeating the process cycle of multi color-recording by holding the intermediate sheet 3 stuck fast to the sheet holding drum 1 and releasing the intermediate sheet 3 from the tight holding; and, after the intermediate sheet 3 is once retrieved, the transcription means is set ON to start transcribing the ink material recorded on the dye depositing layer of the intermediate sheet 3, together with the dye depositing layer, on to the recording sheet 15; by so doing the image recorded on the intermediate sheet 3 may not be injured by the transcription means and the size of apparatus may be made smaller. Further, as the ink sheet 4 is consumed by a smaller unit, the redundant use of the ink sheet can be minimized.

Embodiment 4 of this invention is described below, referring to FIG. 4. The constituent parts of the same function as in Embodiment 1 are given with the same reference numerals, and explanation of which is omitted.

Figure 4:
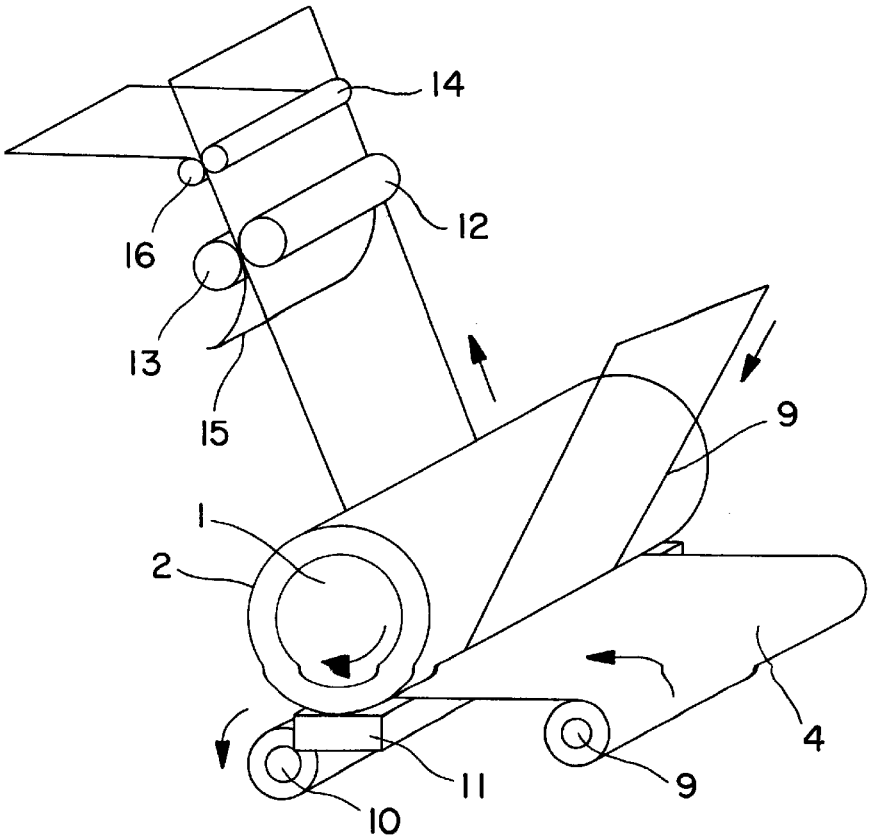
FIG. 4 is perspective view showing the outline constitution of a recording means of the color image recording apparatus according to Embodiment 4 of this invention.

FIG. 4 is perspective view showing the outline constitution of a recording means of the color image recording apparatus according to Embodiment 4 of this invention.

As shown in the FIG., on the ink sheet 4, on its surface facing the intermediate sheet 3, are layers of coloring material made with dyestuff (or pigment) and binder resin. The intermediate sheet 3 is a continuous resin film sheet having a separable dye depositing layer on its surface facing the ink sheet 4. Width of the sheet holding drum 1 is larger than that of the intermediate sheet 3, size of the ink sheet 4 is broader than that of the intermediate sheet 3, and the push-up length of recording head 11 is larger than the width of intermediate sheet 3. Indicated with the numeral 16 is a auxiliary separation roller.

Under the above constitution, the operation is described in the following.

The ink sheet 4 and intermediate sheet 3 are pressed together between the recording head 11 and sheet holding drum 1, the color material layer of ink sheet 4 is heated and prints an image on the dye depositing layer of intermediate sheet 3. Then, the intermediate sheet 3 and recording sheet 15 together are press-heated between the heating roller 12 and pressure roller 13. The dye depositing layer of intermediate sheet 3 melts and is glued on to the recording sheet 15, and then, when they pass between the separation roller 14 and auxiliary separation roller 16 the dye depositing layer of intermediate sheet 3 is transcribed on the recording sheet 15.

The surface of sheet holding drum 1 is, like the case of Embodiment 1 above, made of a sticky smooth rubber material. Therefore, the intermediate sheet 3 is held by the adherence of sheet holding drum 1. The width of sheet holding drum 1 is larger than that of the intermediate sheet 3, the ink sheet 4 is broader than the intermediate sheet 3, and the length of recording head 11 which pushes up the sheet is longer than the width of intermediate sheet 3. The ink sheet 4 is held at its both sides by the adhesion of sheet holding drum 1 caused by the pressure from recording head 11. As the sheet holding drum 1 revolves, the ink sheet 4 is transferred sticking to the sheet holding drum 1, when released from the pressure of recording head 11 the ink sheet peels off-the drum to be rolled up by the ink sheet roll up roller 10. Therefore, the ink sheet 4 is, transferred at exactly the same transfer speed of the intermediate sheet 3, without being influenced by the friction with the recording head 11, or by the variation of the tension given to ink sheet 4.

In order to prevent possible breakage on the recording head 11 that might be caused by the concentration of pressure of recording head 11 at the edges of intermediate sheet 3, it is desirable to provide on the sheet holding drum 1 a recess having a depth of about the thickness of intermediate sheet 3 at the areas where edges of the intermediate sheet 3 locate.

As described above, according to Embodiment 4, where, there are the intermediate sheet 3 made of a continuous base sheet having a transparent dye depositing layer on one of its surfaces, sheet holding means 5, 6 intended to hold the other surface of intermediate sheet 3 stuck fast to the sheet holding drum 1, the ink sheet 4 having ink material layers containing dyestuffs or pigments, the recording head 11 which selectively records the ink material on the dye depositing layer keeping the intermediate sheet 3 sticking on the sheet holding drum 1, and the heating roller 12 and pressure roller 13 intended to transcribe the ink material recorded on the dye depositing layer of said intermediate sheet 3, together with said dye depositing layer, on said recording sheet 15 while keeping the surface of ink material of the intermediate sheet 3 sticking on the recording sheet 15; and, by providing a sticky surface on the sheet holding drum 1, and by making the widths of sheet holding drum 1, ink sheet 4 and recording head 11 larger than the width of intermediate sheet 3, the intermediate sheet 3 and the ink sheet 4 having a broader width than the intermediate sheet 3, both are pressed by the recording head 11, are transferred in a stable manner sticking to the sheet holding drum 1; therefore, even when friction coefficient varies due to change of temperature/moisture the transfer of ink sheet 4 is least influenced; by so doing, a quality image recording is implemented, which is free from wrinkle/breakage of the ink sheet 4, nonuniformity of recording.

Figure 5:
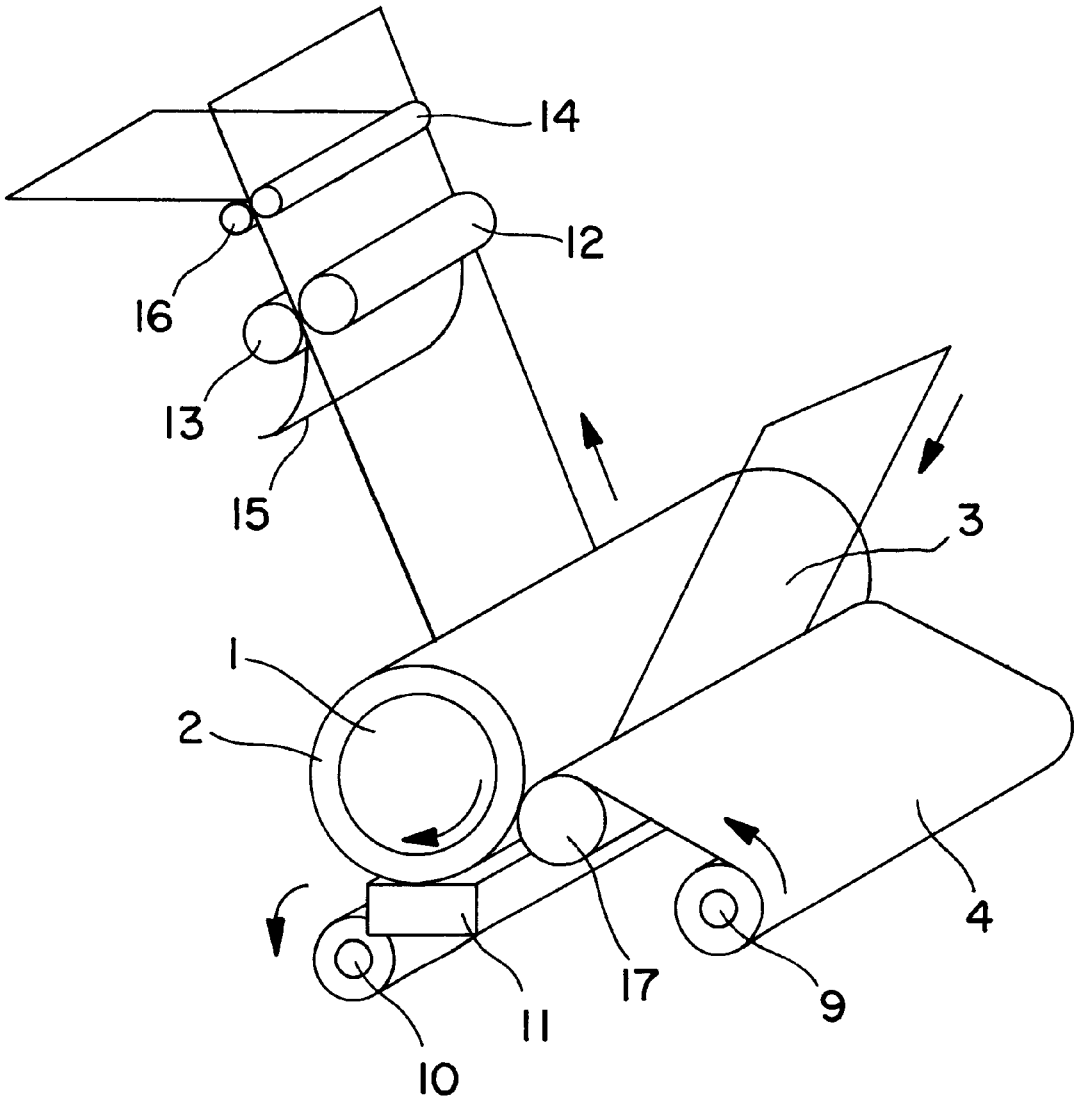
FIG. 5 is perspective view showing the outline constitution of a recording means of the color image recording apparatus according to Embodiment 5 of this invention.

Now, Embodiment 5 of this invention is herewith described referring to FIG. 5. The constituent parts of the same function as in the above Embodiment 4 are given with the same reference numerals, and explanation of which is omitted.

FIG. 5 is perspective view showing the outline constitution of a recording means of the color image recording apparatus according to Embodiment 5 of this invention.

As shown in the FIG., the sheet holding drum 1 has a sticky surface. Pressing roller 17 is positioned before the recording head 11, at the same side of ink sheet dispenser roller 9, to press the ink sheet 4 to the intermediate sheet 3. The required property of the surface of pressing roller 17 is smoothness, that should not injure the rubber surface of sheet holding drum 1; metal rollers such as aluminum, stainless steel may be used. Alike the case of Embodiment 4, widths of the sheet holding drum 1 and ink sheet 4 are larger than width of the intermediate sheet 3, and the width of pressing roller 17 is larger than that of the intermediate sheet 3.

With the above mentioned constitution, the operation is herewith described.

Widths of the sheet holding drum 1 and ink sheet 4 are larger than width of the intermediate sheet 3, and the pressing roller 17 has larger width than the intermediate sheet 3. Therefore, the ink sheet 4 which is pressed by the pressing roller 17 touches direct to the sheet holding drum 1, and sticks tight to the drum because of stickiness of the drum. So, the ink sheet 4 is transferred at the same speed as the intermediate sheet 3, without being influenced by the friction with recording head 11, by the variation of the tension given to the ink sheet 4, and other factors. In this case, there is no need that the recording head 11 should be broader than the intermediate sheet 3 to press the side alley of ink sheet 4, because the pressing roller 17 already serves the same objective.

In this Embodiment, the pressing roller 17 is installed only in the upstream of ink sheet 4, before the recording head 11; but the roller may of course be in the downstream, or in both upstream and downstream of the recording head. In order to prevent possible stain that should be caused on the sticky rubber surface of sheet holdig drum 1 by the direct contact of the color material layers coated on the ink sheet 4, it is desirable to make the width of color material layers smaller than that of the intermediate sheet 3. The same applies to the case of Embodiment 4.

As described above, according to Embodiment 5, where, there are the sticky surface on the sheet holding drum 1, and the pressing roller 17 before and/or after the recording head 11 aiming to make the ink sheet 4 pressed and stuck to the sheet holding drum 1; and by making the width of the pressing roller 17 larger than that of the intermediate sheet 3, further, widths of the sheet holding drum 1 and ink sheet 4 larger than the width of intermediate sheet 3, both the intermediate sheet 3 and the ink sheet 4 having larger width than the intermediate sheet 3 are held sticking to the sheet holding drum 1 by its stickiness to be transferred in a stable manner; therefore, even if the friction coefficient varies due to the change of temperature/moisture the transfer of ink sheet 4 is least influenced; by so doing, a quality color image recording is implemented, which is free from wrinkle/breakage of the ink sheet 4, nonuniformity of recording.

Embodiment 6 of this invention is explained in the following, referring to FIG. 6. The constituent parts of the same function as in Embodiment 4 above are given with the same reference numerals, and explanation to which is omitted.

Figure 6:
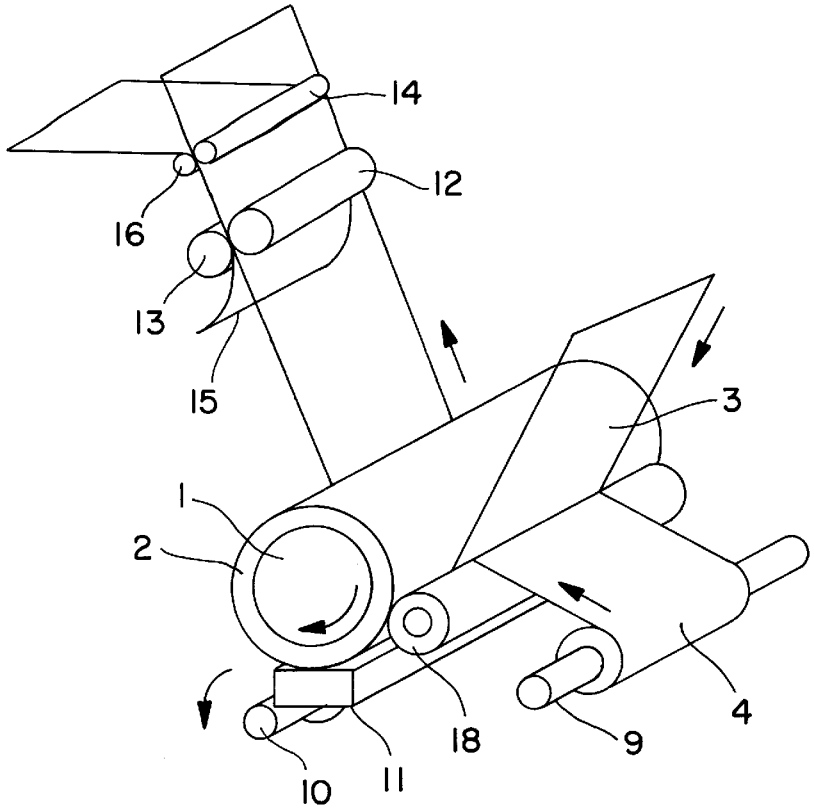
FIG. 6 is perspective view showing the outline constitution of a recording means of the color image recording apparatus according to Embodiment 6 of this invention.

FIG. 6 is perspective view showing the outline constitution of a recording means of the color image recording apparatus according to Embodiment 6 of this invention.

As shown in the FIG., the sheet holding drum 1 has a sticky surface. Contacting rubber roller 18 is installed at the same side of ink sheet dispenser roller 9, before the recording head 11, in order to press the ink sheet 4 to the intermediate sheet 3. Both sides of the contacting rubber roller 18 are pressed to the sheet holding drum 1 to have direct contact. The contacting rubber roller 18 is made with an aluminum pipe, heat-forming the chloroprene-rubber around it, and grinding the surface. The width of sheet holding drum 1 is larger than that of the intermediate sheet 3, width of the ink sheet 4 is smaller than that of the intermediate sheet 3. The contacting rubber roller 18 has larger width than the intermediate sheet 3.

Under the above mentioned constitution, the operation is explained in the following.

Width of the sheet holding drum 1 is larger than that of the intermediate sheet 3, width of the ink sheet 4 is smaller than that of the intermediate sheet 3, and the contacting rubber 18 has larger width than the intermediate sheet 3. Both sides of the contacting rubber roller 18, therefore, touch direct to the sheet holding drum 1; therefore, by the effect of stickiness of the surface of sheet holding drum 1 the contacting rubber roller 18 is driven by and completely follows the revolution of the sheet holding drum 1. The ink sheet 4, which is pressed by the contacting rubber roller 18, receives the revolution torque of contacting rubber roller 18 to be transferred with a substantial force. The ink sheet 4 is, therefore, carried forward at the same speed as the intermdeiate sheet 3 without being influenced by the change of friction with recording head 11, tension given to the ink sheet 4, and other factors.

As the ink sheet 4 is transferred by the friction between the surface of contacting rubber roller 18 and the back surface of the ink sheet 4, the friction coefficient is requested to be high. For the contacting rubber roller 18, silicone rubber, urethane rubber, fluorine-contained rubber, ethylene-propylene rubber, etc. may be used, besides chloroprene rubber. The contacting rubber roller 18 is installed only in the upstream of ink sheet 4, before the recording head 11; however, the roller may of course be in the down stream, or in both upstream and downstream.

As described above, according to Embodiment 6, where, there are a sticky layer on the surface of sheet holding drum 1. Contacting rubber roller 18 in the upstream and/or downstream of the recording head 11 in order to press the ink sheet 4 to the intermediate sheet 3; and as the width of contacting rubber roller 18 is larger than that of the intermediate sheet 3, the width of sheet holding drum 1 is larger than that of the intermediate sheet 3, the width of ink sheet 4 is smaller than that of the intermediate sheet 3, the intermediate sheet 3 which is pressed by the contacting rubber roller 18 sticks to the sheet holding drum 1 to be transferred together in a stable manner, and the ink sheet 4 receives driving force from the contacting rubber roller 18 which is kept in tight contact with the sheet holding drum 1 by the effect of the stickiness to be driven at the equal pace, which means that the ink sheet 4 is transferred in synchronization with the sheet holding drum 1, and that even if the friction coefficient changes due to the change of temperature/moisture the stable transfer of ink sheet 4 is least affected; as the result, a quality image recording is implemented, which is free from wrinkle/breakage of the ink sheet 4, nonuniformity of recording.

Now in the following, Embodiment 7 of this invention is described referring to FIGS. 7~9. The constituent parts of the same function as in Embodiment 1 are given with the same reference numerals, and explanation to which is omitted.

Figure 7:
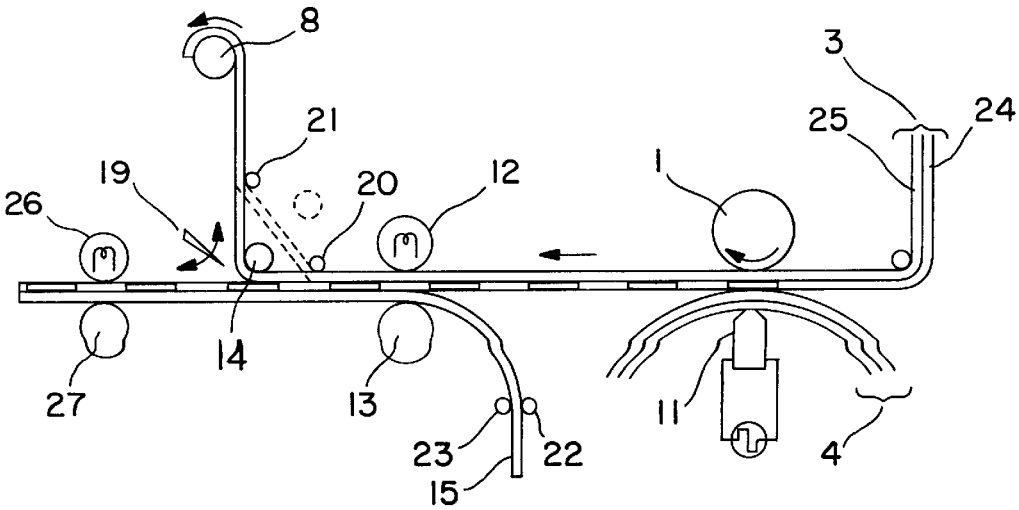
FIG. 7 is front view showing the outline constitution of a separation means of the color image recording apparatus according to Embodiment 7 of this invention.
Figure 8:
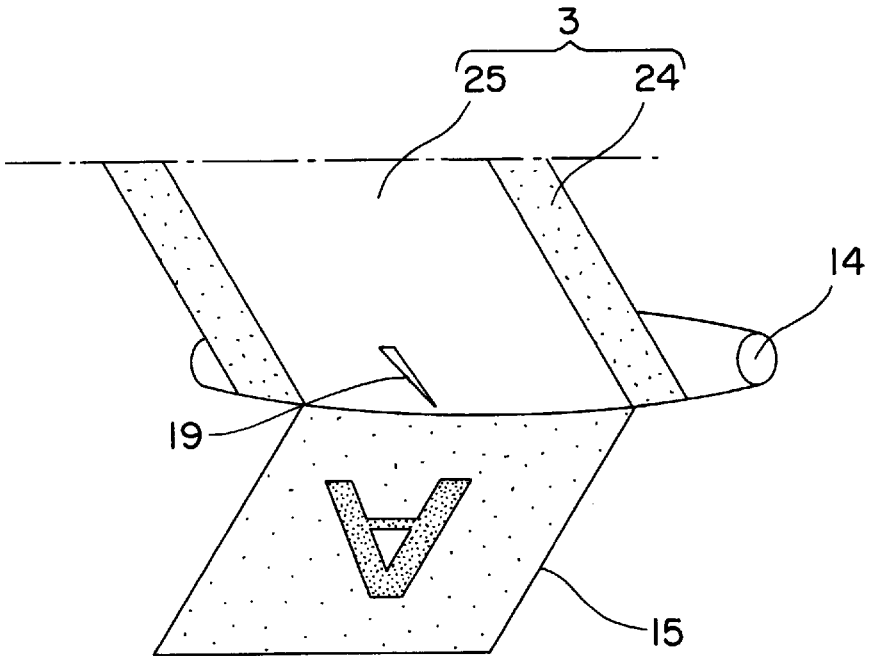
FIG. 8 is perspective view of the above mentioned separation means of color image recording apparatus.

FIG. 7 is front view showing the outline constitution of a separation means of the color image recording apparatus according to Embodiment 7 of this invention. FIG. 8 is perspective view of the separation means of FIG. 7. FIG. 9 illustrates the operation principle of cutting at both sides of the dye depositing layer.

As shown in FIG. 7, there are separation roller 14 and separation nail 19, as separation means. Heating roller 12 houses a heating device and is installed to be revolvable, and is designed to be able to control the heat to be conveyed by thermal conduction to the intermediate sheet 3 by controlling the electricity supply for the heating device. Intermediate sheet guide axes 20, 21 are intended to guide the intermediate sheet 3, and are installed to be freely revolvable. The separation roller 14 is a crown roller made of stainless steel, as shown in FIG. 8, whose diameter at the middle point is 6 mm, and 3 mm at the point 120 mm from the middle, radius of curvature 4800 mm, and is installed to be freely revolvable. Furthermore, the separation roller 14 is designed to be retractable to keep off the intermediate sheet 3 unless it is on separation work.

With the above mentioned constitution, the operation is explained below.

During recording operation, the heating roller 12. pressure roller 13 and the separation roller 14 having a convex shape are kept off the intermediate sheet 3. The intermediate sheet 3 touches only with the intermediate sheet guide axes 20, 21, which have a straight shape and are revolvable; so, the intermediate sheet 3 may have no wrinkle, and is rolled up by the intermediate sheet roll up roller 8 with a small force.

When the recording sheet 15 is detected passing through resist rollers 22, 23, the heating roller 12, the pressure roller 13, the separation roller 14 and the separation nail 19 move to make contact with the intermediate sheet 3. The recording sheet 15 and the intermediate sheet 3 having dye depositing layer 24 which contains a recorded image are held superposed and go through the heating roller 12 and the pressure roller 13; when the entire surface of substrate 25 of intermediate sheet is heated by the heating roller 12 the dye depositing layer 24 softens, and part of the dye depositing layer 24 on the intermediate sheet 3, which is press-heated, diffuses into the recording sheet 15, thus, the intermediate sheet 3 and the recording sheet 15 go into a situation as if they are glued together.

Then, the recording sheet 15 and the intermediate sheet 3 are transferred, and cooled in the glued state. The ability of transcription between the recording sheet 15 and the dye depositing layer grows as the dye depositing layer gets cooled. The intermediate sheet 3 is sufficiently cooled, and then bent upward by the separation roller 14 which is positioned at a place where the ability of transcription between the dye depositing layer 24 and the recording sheet 15 has grown high enough. When, as the intermediate sheet 3 is being rolled up by the intermediate sheet roll up roller 8, the intermediate sheet 3 is sticking to the separation roller 14. In the mean time, the recording sheet 15 tends to go straight forward by its own rigidity after passing the separation roller 14. At this moment, the transcription ability between the recording sheet 15 and the dye depositing layer 24 is strong enough, the separating force due to rigidity of the recording sheet 15 itself is larger than the sum of shearing strength of dye depositing layer 24 and force of separation from the substrate 25 of intermediate sheet, and the shearing strength of dye depositing layer 24 at the front of recording sheet 15 has become very small because part of the dye depositing layer 24 has diffused into the recording sheet 15. As the result, the dye depositing layer 24 is cut off at the front of recording sheet 15, and separated from the substrate 25 of intermediate sheet to be transcribed on the recording sheet 15. As the recording sheet is transferred along with the intermediate sheet 3, the dye depositing layer 24 is transcribed accordingly on to the recording sheet 15.

After the transcription, the recording sheet 15 is held by fixing•pressing roller 27 and heating roller 26, which are designed to work also as recording sheet carrier. The distance from the separation roller 14 to the contacting point of heating roller 26 and fixing•pressing roller 27 is constituted to be shorter than the length of recording sheet 15 in its transfer direction, furthermore, the circumferential speed of heating roller 26 and fixing•pressing roller 27 is set at slightly higher than the transfer speed of intermediate sheet 3. Because of such arrangement, the recording sheet 15 is given with a weak tension in its transfer direction, after it is press-held by the heating roller 26 and fixing•pressing roller 27. The tensile strength of dye depositing layer 24 at the rear end of recording sheet 15 is very small as part of the dye depositing layer 24 has diffused into the recording sheet 15, and the tension given to recording sheet 15 is made larger than said tensile strength. As the result, the dye depositing layer 24 is cut off, as soon as the rear end of recording sheet 15 reaches the separation position, along the rear end.

Through the above mentioned procedure, an image recorded on the intermediate sheet 3 is formed on the recording sheet 15, and delivered. The separation nail 19 helps the recording sheet 15 peel off intermediate sheet 3, also helps the recording sheet go straight.

In the case where the width of recording sheet 15 is smaller than that of the dye depositing layer 24 of intermediate sheet 3, because the separation roller 14 has an extruding shape in its middle part against its both sides, the dye depositing layer 24 is sharply incised along the edges of both sides of recording sheet 15.

Figure 9:
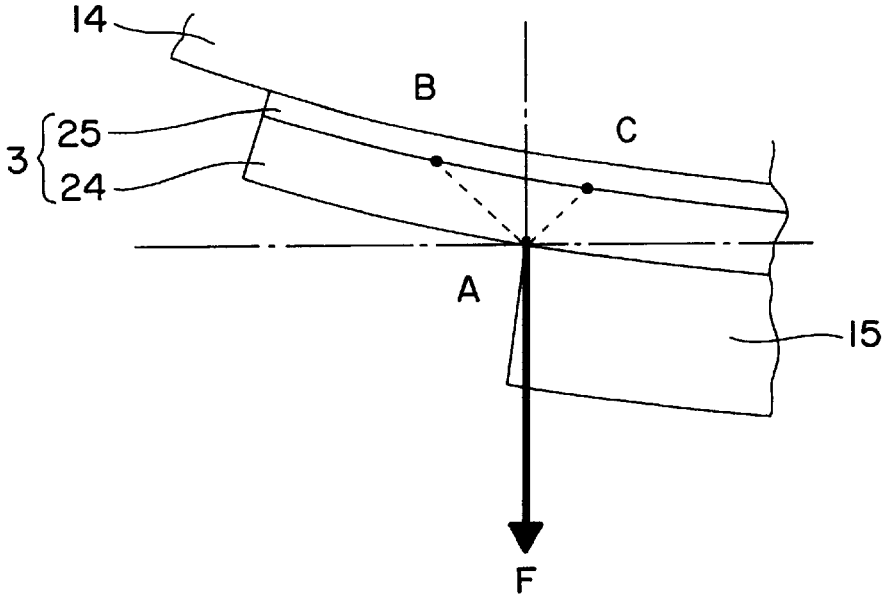
FIG. 9 explains operation principle of the above mentioned separation means of color image recording apparatus.

Then, referring to FIG. 9, the principle of incision of dye depositing layer 24 along the both side-edges of the recording sheet 15 is described.

In FIG. 9, point A designates the place where there is side-edge of the recording sheet 15 on the dye depositing layer 24, points B and C the place where the cutting direction of dye depositing layer 24 cross the substrate 25 of intermediate sheet, the separation force F is the force given to point A caused by the rigidity of recording sheet 15. The separation force F of recording sheet 15 is generated by the rigidity of recording sheet 15 itself, when the recording sheet 15 sticks fast over the surface of separation roller 14, towards the direction of rotating with the summit of separation roller 14 as the center. At point A, the direction is as indicated with F.

As a general rule, the direction of incision of a material is 45° to the force applied to. Therefore, the incision direction is towards point B from point A, or point C from point A. Comparing the lengths of A–B and A–C, A–C is shorter and the incision takes place from point A towards point C, which direction needs less force for incision. When the separation roller 14 is extruding in its middle part against the ends, the incision force is always directed towards middle of the recording sheet 15; so, the dye depositing layer 24 is sharply cut off along the both side-edges of recording sheet 15. By making the extrusion of separation roller 14 larger, the separation force F caused by rigidity of recording sheet 15 can be made larger, leading to easier cutting. Taking advantage of such principle, a good incision of the dye depositing layer 24 along the side-edges may be obtainable even when a less rigid material such as thin paper is used as the recording sheet 15.

Regarding the separation roller 14, its diameter at the middle should be small, preferably smaller than 20 mm. The shape of extrusion of the separation roller 14 is not limited to be a part of the circular arc, like this Embodiment case; it may also be oval, curve, straight line, or a compound shape of these lines. The separation means may be made of either, folded sheet metal, bent rod, or bent rod plus plurarity of cylindrical structures attached on it in a revolvable manner.

Figure 10:
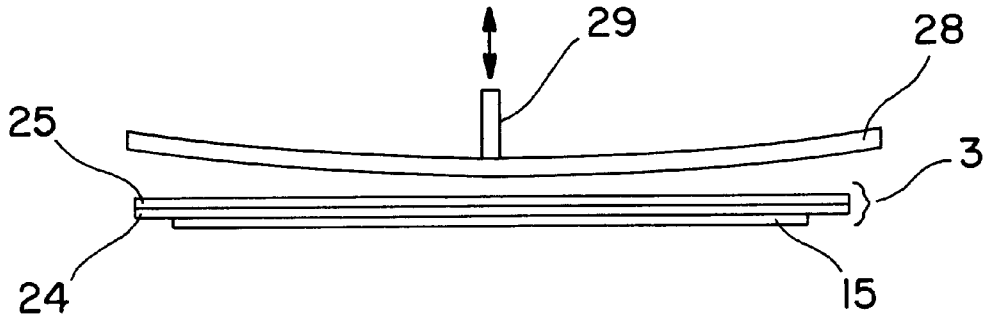
FIG. 10 is cross-sectional view showing the outline constitution of other separation means of the above mentioned color image recording apparatus.

Illustrated in FIG. 10 is an example; a 3 mm diameter stainless steel separation roller 28 is installed revolvable. During the separation work the separation roller 28 is pushed at its middle part by pushing device 29, and the surface in the direction of axis at the separation position of the substrate 25 of intermediate sheet and recording sheet 15, which are on the separation roller 28, is made extruded. Then, the curvature of separation roller 28 turns out to be a curve of secondary degree, not a circular arc. When out of separation work, the pushing device 29 is retracted, and the separation roller 28 straightens so as to impose no load in the transfer of intermediate sheet 3. The pushing device 29 may be constituted with, besides sheet metal as shown in FIG. 10, some revolving item such as a ballbearing.

Referring again to FIG. 7, the intermediate sheet 3 is illustrated to be covering the separation roller 14 by about a quarter of circumference of the separation roller 14. However, by increasing the degree of covering and increasing the contacting space of the intermediate sheet 3 with the separation roller 14, the separation force due to rigidity of the recording sheet 15 itself can be made larger; by doing this way the cutting performance of the dye depositing layer 24 at the edges of recording sheet 15 may further be promoted.

As described above, according to Embodiment 7, where, there are intermediate sheet 3 which is made of a continuous substrate sheet 25 having a transparent dye depositing layer 24 on one of the surfaces, recording head 11 which selectively records an image on the dye depositing layer 24, heating roller 12 and pressure roller 13 which are intended to heat•press the dye depositing layer 24, carrying an image recorded in it, of intermediate sheet 3 and the recording sheet 15 contacting to the layer in order to have the dye depositing layer 24 transcribed on to the recording sheet 15, and separation roller 14 to separate the recording sheet 15 from the intermediate sheet 3; by shaping the separation roller 14 extruded at the middle part against both ends, the dye depositing layer 24 carrying a recorded image is sharply cut off at both side-edges of the recording sheet 15; and a quality image is produced on any desired recording sheet 15. And by making the separation roller 14 retractable from the intermediate sheet 3, the stable transfer of intermediate sheet 3 is assured, without inviting wrinkle on the intermediate sheet 3; thus, the reliability of apparatus is increased.

Figure 11:
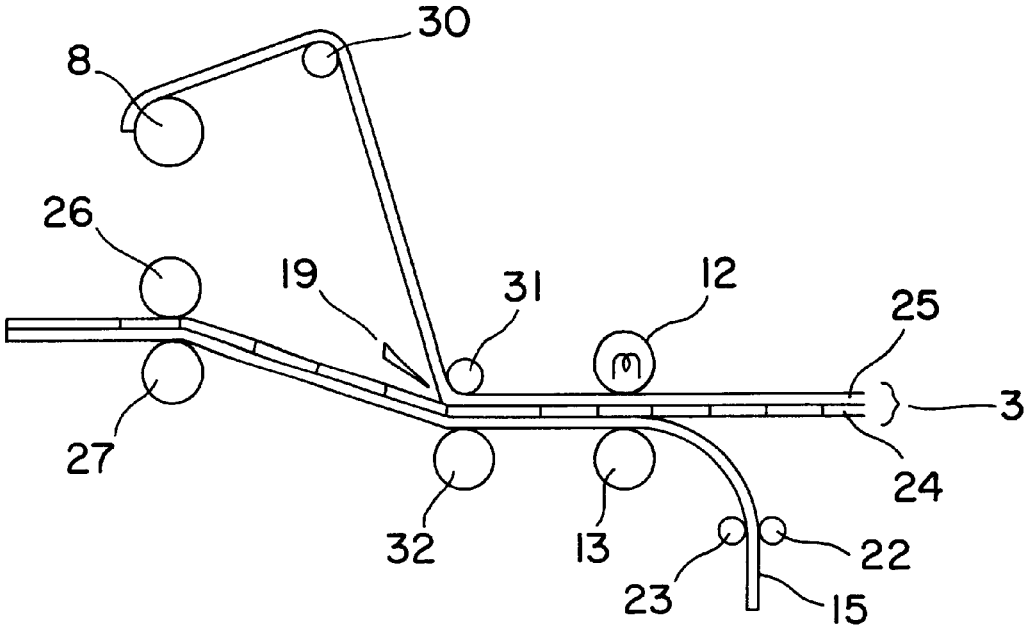
FIG. 11 is front view showing the outline constitution of a separation means of the color image recording apparatus according to Embodiment 8 of this invention.
Figure 12:
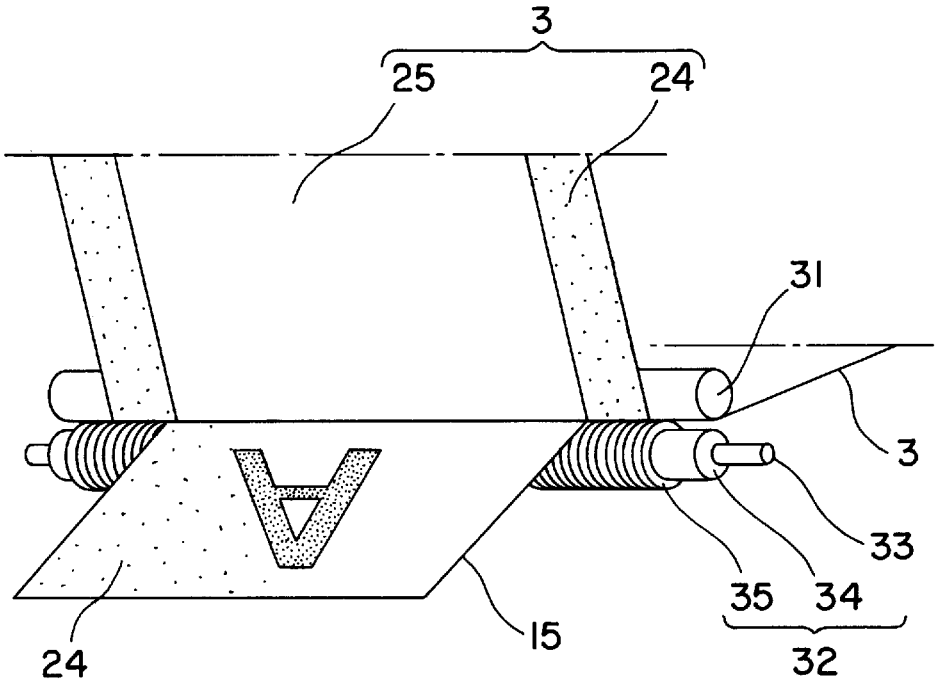
FIG. 12 is perspective view showing the above mentioned separation means of color image recording apparatus.
Figure 13:
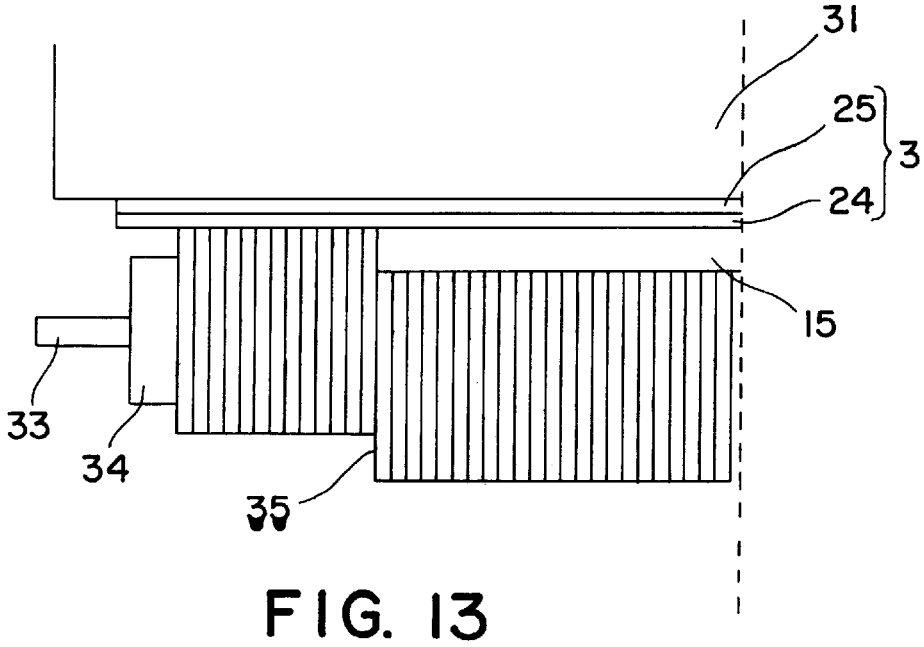
FIG. 13 explains operation of the above mentioned separation means of color image recording apparatus.

Now herewith, Embodiment 8 of this invention is described referring to FIGS. 11~13. The constituent parts of the same function as in Embodiment 7 above are given with the same reference numerals, and explanation to which is omitted. FIG. 11 illustrates the outline construction of a separation means of the color image recording apparatus according to Embodiment 8 of this invention. FIG. 12 is perspective view of the separation means of FIG. 11. FIG. 13 illustrates the principle of separation work at the side-edges of recording sheet.

As shown in FIG. 11, intermediate sheet guide axis 30 is intended to guide the intermediate sheet 3. The contacting position of heating roller 26 and fixing•pressing roller 27 (the position where the recording sheet 15 is held) is located 2 mm higher than the line extended straight from the line of the intermediate sheet 3 entering the separation roller (separation means) 31. Auxiliary separation roller (auxiliary separation means) 32 is, as shown in FIG. 12, made up of a 6 mm diameter stainless steel core 33, clad with 2 mm thick elastic layer 34 made of foamy silicone rubber of hardness 20, around which are Teflon pieces of cylindrical shape 35 (0.25 mm thick, 8 mm inner diameter, 10 mm outer diameter) stacked in the direction of axis. The intermediate sheet guide axis 30 and the auxiliary separation roler 32 are installed freely revolvable. The auxiliary separation roller 32 is designed to be retractable, off the intermediate sheet 3, unless it is on separation work.

With the above mentioned setup, the operation is described below.

When the recording sheet 15 is detected passing between the heating roller 12 and the pressure roller 13, the auxiliary separation roller 32 moves to make contact with the intermediate sheet 3. The heat•pressed intermediate sheet 3 is cooled while being glued, and the transcription capability between recording sheet 15 and dye depositing layer 24 increases. The intermediate sheet 3 is bent upward by the separation roller 31, which is located at the position where the sheet is sufficiently cooled and the transcription capability between dye depositing layer 24 and recording sheet 15 is sufficiently increased, and by the intermediate sheet guide axis 30. Then, the intermediate sheet 3 is sticking to the separation roller 31 as the sheet is pulled by the revolution of intermediate sheet roll up roller 8, and, by the effect of intermediate sheet guide axis 30, the angle of intermediate sheet 3 relative to the transfer direction of recording sheet 15 is always maintained fixed, irrespective of change in diameter of the intermediate sheet roll up roller 8.

After passing through the separation roller 31 and auxiliary separation roller 32, the recording sheet 15 tends to go straight forward by its own rigidity. At this stage, the transcription capability between the recording sheet 15 and the dye depositing layer 24 is sufficiently strong, and the separation force caused by the rigidity of recording sheet 15 itself is larger than the sum of shearing strength of dye depositing layer 24 and the separation force from the substrate 25 of intermediate sheet, and the shearing strength of dye depositing layer 24 at the front edge of recording sheet has become very weak because part of the dye depositing layer 24 has been diffused into the recording sheet 15. Consequently, the dye depositing layer 24 is cut off at the front edge of recording sheet 15, separated from the substrate 25 of intermediate sheet to be transcribed on to the recording sheet 15.

When the auxiliary separation roller 32 is placed to press•touch on the recording sheet 15 and intermediate sheet 3, both being glued together, opposing to the separation roller 31, the cylindrical-shape pieces 35 of auxiliary separation roller 32 directly touch•presses the intermediate sheet 3 in the area where there is no recording sheet 15. In the area of recording sheet 15, the cylindrical-shaped pieces 35 of auxiliary separation roller 32 touches on the recording sheet 15; when, as the elastic layer 34 functions as a damper, the recording sheet 15 is pressed without causing the axis of core 33 shift its location. Because each of the cylindrical-shaped pieces 35 is as thin as 0.25 mm, the pressure can be given along the side edges of recording sheet 15, so, when the recording sheet 15 is to be separated the area of dye depositing layer 24 which is not touching the recording sheet is left as it is on the intermediate sheet 3; in this way, the dye depositing layer 24 is incised along the side edges of the recording sheet, along with progress of the transcription process.

Having been transcribed, the recording sheet 15 is transferred by the heating roller 26 and fixing•pressing roller 27, which are designed to work as carrier, and as fixing means. The distance from the separation roller 31 to the contacting point of heating roller 26 and fixing•pressing roller 27 is constituted to be shorter than the length of recording sheet 15 in its transfer direction, furthermore, the circumferential speed of heating roller 26 and fixing•pressing roller 27 is set at slightly higher than the transfer speed of intermediate sheet 3. The position at which the recording sheet 15 is held by the heating roller 26 and fixing•pressing roller 27 is designed to locate somewhere between the extended line of intermediate sheet 3 going to the separation roller 31 and the direction of intermediate sheet 3 getting out of the separation roller 31. Because of such setup, the recording sheet 15 is given with a weak tension towards a slant upward direction after it is held by the heating roller 26 and fixing•pressing roller 27.

The tensile strength of dye depositing layer 24 at the rear end of recording sheet 15 is very small as part of the dye depositing layer 24 has diffused into the recording sheet 15, and the tension towards a slant upward direction given to recording sheet 15 is larger than said tensile strength. As the result, the dye depositing layer 24 is cut off along the rear edge of recording sheet 15 when the rear end of recording sheet 15 reaches the separation position. Through the processes as described above, an image recorded on the intermediate sheet 3 is formed on the recording sheet 15, and delivered.

The hardness of the elastic layer 34 in Embodiment 8 should be low, preferably lower than hardness 50. Besides the foamy silicone rubber, other elastic materials may be used, such as silicone rubber, urethane rubber, chloroprene rubber, and those of foamed ones. The preferred material for the cylindrical pieces 35 is those whose separation property with the dye depositing layer 24 is smaller than that between the dye depositing layer 24 and the substrate 25 of intermediate sheet; besides the resin material such as Teflon (trademark of Du Pont Co.), rubber materials such as, silicone rubber, urethane rubber may be used.

As to the thickness of cylindrical pieces 35, thinner the construction the better result is obtainable; preferably less than 1 mm, as it is requested to have direct contact with the dye depositing layer 24 along the side-edges of recording sheet 15 whenever a recording sheet of any size is used. The function of auxiliary separation roller 32 expected to perform is to make a tight contact with the dye depositing layer 24 without allowing any clearance at both side-edges of the recording sheet 15; therefore, besides what is described above, a soft rubber roller, a sponge roller having the hardness below 30 may serve the same purpose.

As described above, according to Embodiment 8, where, there are the intermediate sheet 3 which is made of a continuous substrate sheet 25 having a transparent dye depositing layer 24 on one of the surfaces, the recording head 11 which selectively records an image on the dye depositing layer 24, the transcribing means which transcribes the dye depositing layer 24 of intermediate sheet 3 having an image recorded in it on to the recording sheet 15 by heat•pressing the dye depositing layer 24 sticking to the recording sheet 15, the separation roller 31 to separate the recording sheet 15 from the intermediate sheet, and the auxiliary separation roller 32 which touches to the recording sheet 15 at the separation position from the recording sheet 15 side; by making the auxililary separation roller 32 to touch the dye depositing layer 24 along the side-edges of recording sheet 15 from the recording sheet side the image-bearing dye depositing layer 24 is sharply cut off along the side-edges of recording sheet; through such processes a quality image is formed on any desired recording sheet 15. Furthermore, by installing the heating roller 26 and fixing•pressing roller 27, which also work as carrier of the recording sheet, somewhere between the line extended from the direction of intermediate sheet going towards the separation roller 31 and the line of intermediate sheet 3 getting out of the separation roller 31, the cutting of dye depositing layer 24 at the rear end of recording sheet 15 takes place in further favourable manner. By maintaining the direction of intermediate sheet 3 getting out of the separation roller 31 fixed, the separation force due from the rigidity of recording sheet is maintained constant; so, a stable image forming is implemented.

Embodiment 9 of this invention is described in the following, referring to FIG. 14. The constituent parts of the same function as in the above Embodiment 1 or Embodiment 7 are given with the same reference numerals, and explanation to which is omitted.

Figure 14:
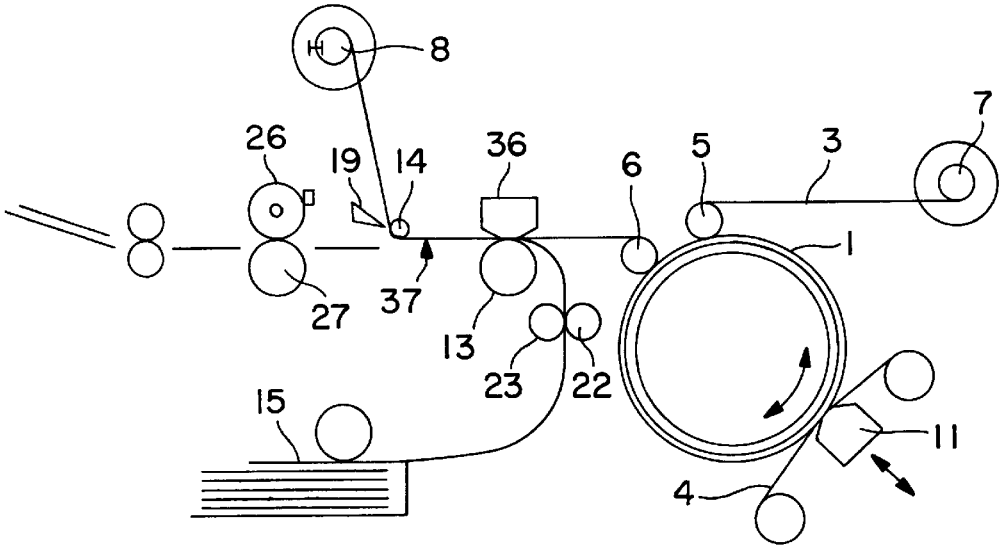
FIG. 14 is front view showing the outline constitution of the transfer control at separation of the color image recording apparatus according to Embodiment 9 of this invention.
Figure 15:
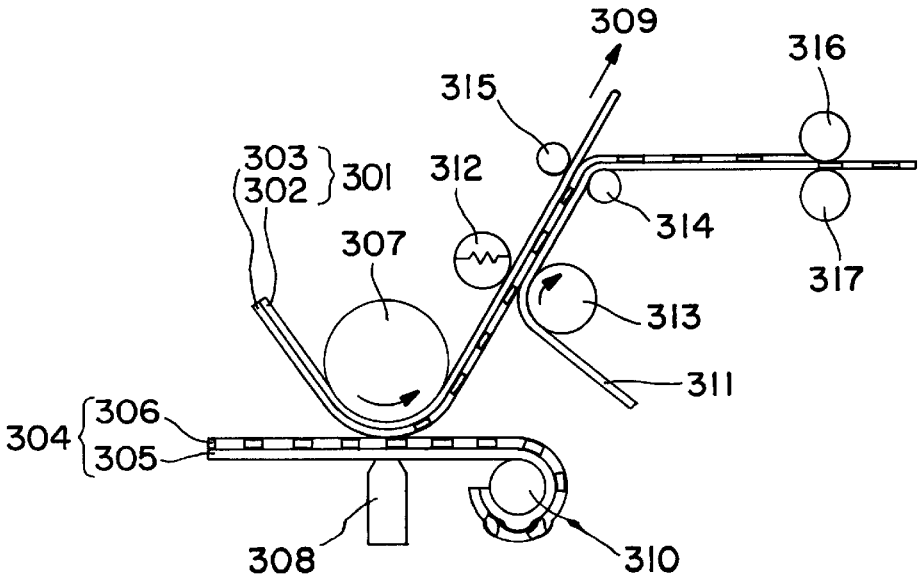
FIG. 15 PRIOR ART
FIG. 15 is front view showing the outline constitution of a conventional thermal transcription recording apparatus using an intermediate sheet.

FIG. 14 illustrates the outline constitution of transfer control at separation of the intermediate sheet and recording sheet in a transcription means of the color image recording apparatus according to Embodiment 9 of this invention.

As shown in the FIG., heating element 36 is installed facing pressure roller 13. Recording sheet detection sensor 37 is intended to detect the recording sheet, and is a reflection type photosensor. Heatig roller 26 and fixing•pressing roller 27, which are intended to be a fixing means, also work as a carrier to out-transfer the recorded recording sheet 15.

With the above mentioned setup, running speed of the intermediate sheet 3 at separation in the transcription means is explained below.

The recording sheet 15 is sent out to the transcription means by resist rollers 22, 23 at a certain timing so that it meets an image recorded on the intermediate sheet 3. The heat•pressed intermediate sheet 3 is cooled while being glued with the recording sheet 15, thus the ability of transcription between recording sheet and dye depositing layer increases. The intermediate sheet is then bent upward by the separation roller 14 which is positioned at a place where the intermediate sheet 3 is sufficiently cooled and the ability of transcription between the dye depositing layer 24 and recording sheet 15 is sufficiently intensified. Then, the intermediate sheet 3 is transferred sticking to the separation roller 14 because the intermediate sheet 3 is rolled by revolution of intermediate sheet roll up roller 8.

Running speed of the intermediate sheet 3 after the heating element 36 and pressure roller 13 is decided by the speed, slower of the circumferential speed of the sheet holding drum 1 or the pressure roller 13, while transfer speed of the recording sheet 15 after the separation roller 14 is decided by the circumferential speed of the heating roller 26 and fixing•pressing roller 27.

By stopping revolution of the sheet holding drum 1 for a moment immediately before and after the rear end of recording sheet 15 passes the separation roller 14, running speed of the intermediate sheet 3 relative to transfer speed of the recording sheet 15 is made slower. The running speed of intermediate sheet 3 may be controlled in an exact timing by detecting the rear end of recording sheet 15 with the recording sheet detection sensor 37 and change the speed after a certain moment elapsed. As the result, a pulling force is caused between the dye depositing layer 24 transcribed on the recording sheet 15 and the dye depositig layer 24 staying on the intermediate sheet 3, so, the rear end of dye depositing layer 24 transcribed on the recording sheet 15 is cut off along the rear edge of recording sheet 15; thus, a quality image is produced.

In order to have the rear end of dye depositing layer 24 transcribed on the recording sheet 15 cut off along the rear edge of recording sheet 15, speed of the intermediate sheet 3 relative to that of the recording sheet 15 must be lowered at least during the moment immediately before and after the rear end of recording sheet 15 passes the separation roller 14; or, by either reducing or reversing the transfer of intermediate sheet 3, or accelerating the running speed of recording sheet 15 the same effect is obtainable.

Also, the circumferential speed of the heating roller 26 and fixing•pressing roller 27, which are designed to work also as carrier of recordig sheet, may be set faster so that the transfer speed of recording sheet 15 having the transcribed dye depositing layer 24 is always slightly faster than the running speed of intermediate sheet 3. When, the recording sheet 15 held between the heating roller 26 and fixing•pressing roller 27 runs slipping until when the rear end of recording sheet passes the separation roller 14. An experiment was conducted to confirm the relationship between the image quality and the ratio of speed between running speed of the intermediate sheet 3 and circumferential speed of the heating roller 26, which is designed to work also as carrier of the recording sheet 15; as the result, it has become known that when the circumferential speed of heating roller 26 is made faster than the running speed of intermediate sheet 3 by within the range of 0.8%~6%, the rear end of dye depositing layer 24 transcribed on the recording sheet 15 is cut off beautifully along the rear edge of recording sheet 15 to deliver a quality image. Experimental results are as shown below.

At speed ratio 1:1, the dye depositing layer 24 is not cut off along the rear edge of recording sheet 15.

At speed ratio 1:1.006, occasionally the dye depositing layer is not cut off along the rear edge of recording sheet 15.

At speed ratio within the range 1:1.008~1.06, the dye depositing layer 24 is cut off along the rear edge of recording sheet 15.

At speed ratio 1:1.7 and over, the dye depositing layer 24 is cut off along the rear edge of recording sheet 15, but the intermediate sheet 3 is pulled more than necessary by recording sheet 15 and the speed of intermediate sheet 3 is increased; consequently, image quality deteriorated due to abnormal revolution of the sheet holding drum 1 and deteriorated transcribing capability of the dye depositing layer 24.

As described above, in Embodiment 9, where, there are intermediate sheet 3 which is made of a continual substrate sheet 25 having a transparent dye depositing layer 24 on one of the surfaces, recording head 11 which selectively records an image on the dye depositing layer 24, transcription means to transcribe the dye depositing layer 24 on to the recording sheet 15 by heat•pressing the dye depositing layer 24 of intermediate sheet 3 to the recording sheet 15 with the dye depositing layer 24 carrying an image held stuck to the recording sheet 15, separation means to separate the recording sheet 15 from the intermediate sheet 3, and transfer means to carry the separated recording sheet 15; by increasing the transfer speed of recording sheet 15 relative to that of the intermediate sheet 3 at least during the moment immediately before and after the rear end of recording sheet passes the separation means, the dye depositing layer 24 transcribed on the recording sheet 15 is cut off beautifully along the rear edge of the recording sheet, and a quality image is produced.

Now in the following, the structure of components and material employed in the above mentioned Embodiments are explained with practical examples.

The sticky surface of sheet holding drum was prepared, with 2 mm thick aluminum drum as base, covering over it with 4 mm thick chloroprene rubber, and gluing over it 1 mm thick silicone type rubber (a mixture of sticky silicone and non-sticky silicone).

As to processing method of the surface material, it can be either making a tube beforehand and putting it on afterwards, or making direct by molding with die; anyway, the method how it is processed is irrelevant.

As to the sticky material, fluorine-contained silicone rubber, fluorine-contained rubber, urethane rubber, chlorosulfonated polyethylene, etc. may be used, besides the material mentioned already.

The stickiness depends also on smoothness of the rubber surface; the nearer to the mirror surface higher the stickiness. The stickiness higher than 0.1 g/inch in terms of the separation force when the intermediate sheet is peeled off (ref. JIS Z0237) is effective to prevent thermal shrinkage of the intermediate sheet; taking the transferability of intermediate sheet the value higher than 1 g/inch, lower than 3 g/inch is appropriate. The effect is measured by shrinking quantity of the intermediate sheet after it is recorded by the thermal head pressed on it with the energy of 5 J/cm$^2$. The thermal shrinkage when the separation force of surface of sheet holding drum is 0.1 g/inch was 80$\mu$ per 200 mm width, when more than 1 g/inch it was 20$\mu$. For the information, when a rubber material having no stickiness was used thermal shrinkage was observed for about 300$\mu$.

The intermediate sheet used is polyethylene terephthalate film (12$\mu$ thick, Lumirror which is a trademark of Toray Co.) as the substrate, coated with the paint consisting, 4 weight parts of polyvinyl butyral resin (BL-S, average degree of polymerization: about 350, made by Sekisui Chemical Co., Ltd.), 0.24 weight parts of siloxane-containing acrylsilicone resin solution (F-6A, effective component 54 wt %, made by Sanyo Chemical Industrial Co., Ltd.). 0.001 weight parts of di-n-butyltin dilaurate, 18 weight parts of toluene and 18 weight parts of 2-butanone to form the dye depositing layer.

As the substrate of intermediate sheet, various polymer films may be used; for example, film of polyolefin type, polyamide type, polyester type, polyimide type, polyether type, cellulose type, polyoxadiazole type, polystyrene type, and polyfluoride type.

Among others, films of polyethylene terephthalate, polyethylene naphthalate, aromatic polyamide, triacetylcellulose, polyparabanic acid, polysulfone, polypropylene, cellophane, cellophane treated moisture resisting treatment, polyethylene and so on are useful.

The dye depositing layer is made at least of macromolecule. As the macromolecule, various macromolecules may be used, for example, acrylic type resin, styrene type resin, urethane type resin, polyester type resin, polyvinylacetal type resin, vinylacetate type resin, amide type resin, cellulose type resin and chlorinated resin. Especially when at least one chosen out of acrylonitrile-styrene copolymer, polystyrene, styrene-acryl copolymer, saturated polyester, polyesterurethane, chlorinated rubber, chlorinated polypropylene, polyvinyl chloride, chlorinated vinyl chloride resin, vinyl chloride-vinyl acetate copolymer (including those copolymerized with other components such as vinylalcohol and maleic acid), vinyl chloride-acrylicester copolymer (including multicomponent copolymers which are made of plural acrylicesters), vinylacetate resin, polycarbonate and cellulose group resin is used, a favourable recording is performed in the sublimation type dyestuff transcription recording with high recording sensitivity.

The most preferred are those macromolecules whose glass transition point is within the range of 40° C.–150° C., average degree of polymerization is within the range of 150° C.–3000° C., or flow softening temperature is below 300° C. For the objective of transcription of dye depositing layer on to recording sheet, or fixing of the resin of dye depositing layer into the fiber of paper, in the case where the recording sheet is porous such as paper, a macromolecule of small molecular weight, or a macromolecule whose flow softening temperature is below 250° C. is especially recommendable. Because the dye depositing layer carrying an image is to be trascribed on the recording sheet, the dye depositing layer should be a macromolecule of high transparency. As macromolecule of the dye depositing layer, polyvinylacetal is specifically preferred. Polyvinylacetal is especially useful when it is produced using polyvinylalcohol, various kinds of aldehyde such as formaldehyde and acetaldehyde, propionicacetal, polyvinylbutyral and so on.

Ink sheet was made by making use of a sublimation type thermal transcription recording sheet in the following way.

On the anchor coat layer of polyethylene terephthalete film, which has a smooth heat resisting layer on its bottom surface, three color-paints, viz. cyanine, magenta and yellow, are individually painted to produce an ink sheet having three color-layers.

Composition of each color paint is as follows:

| Composition of each color paint is as follows: | |
|---|---|
| Paint of cyanine color material layer | |
| indoaniline type disperse dye | 3.5 weight part |
| acrylonitrile-styrene copolymer | 4 weight part |
| amido modified silicone oil | 0.04 weight part |
| titanium oxide | 0.24 weight part |
| toluene | 25 weight part |
| 2-butanone | 25 weight part |
| Paint of magenta color material layer | |
| azo type disperse dye | 3 weight part |
| acrylonitrile-styrene copolymer | 4 weight part |
| amide modified silicone oil | 0.04 weight part |
| titanium oxide | 0.24 weight part |
| toluene | 25 weight part |
| 2-butanone | 25 weight part |
| Paint of yellow color material layer | |
| dicyanomethine type disperse dye | 3 weight part |
| acrylonitrile-styrene copolymer | 4 weight part |
| amide modified silicone oil | 0.04 weight part |
| titanium oxide | 0.24 weight part |
| toluene | 25 weight part |
| 2-butanone | 25 weight part |

Using the ink sheet as per the above mentioned, recording was conducted under the following conditions, pressing (about 3 kg) the thermal head to sheet holding drum.

| | |
|---|---|
| Recording speed: | 4 ms/line |
| Recording pulse width: | 0.2~3.8 ms |
| Recording energy: | 5 J/cm$^2$ |

Besides, a melting type recording ink sheet is also usable. In this case, an ink sheet having cyanine, magenta and yellow color material layers, viscosity of which when melted is 100,000 centipoise, was used under the following recording conditions.

| | |
|---|---|
| Recording speed: | 1.6 ms/line |
| Recording pulse width: | 1.4 ms |
| Recording energy: | 2.4 J/cm$^2$ |

Furthermore, it is possible to record on the dye depositing layer of intermediate sheet with color materials of sublimation type thermal recording and those of melting type recording mixed. It is one of the remarkable effects of this invention to make it possible to produce a recorded image of very high quality by taking advantage of the excellent features of each of the recording method; for example, recording on dye depositing layer a photograph picture by means of thermal recording with sublimation type dyestuff, and recording letters with melting type color material.

As explained alone, this invention reveals its outstanding advantage in the thermal recording method where the intermediate sheet shrinks at recording. But it is not limited only in this recording method; also in a color recording method employing overlaying of colors, such as ink jet recording, this invention provides such excellent features as the high accuracy in repeated positioning and that it produces a quality image regardles of the kind of recording sheet.

As to the sheet holding body, a shape of cylindrical "drum", which has simple working mechanism, was used as example in the above mentioned descriptions. However, this invention does not intend to restrict the shape to "drum"; other shapes such as the end-less belt, or flat sheet may be the shape of sheet holding body to create the same effect.

As described in the above passages, the invention makes it possible to produce a quality color image of precise alignment of color elements. This invention also makes it possible to produce a color image of excellent picture quality on any desired recording body at any time, without being influenced by environmental conditions, or by the kind of recording body. The ink sheet in this invention is consumed by a small block unit, which enables to minimize the loss of ink sheet. The simplicity in setup of apparatus of this invention contributes to make the apparatus compact and low-priced.

What is claimed is:

1. A color image recording apparatus comprising:

an intermediate sheet made of a continuous substrate sheet having a transparent dye depositing layer on a first surface of said intermediate sheet;

a sheet holding body having a sticky surface;

means to hold a second surface of said intermediate sheet to the sticky surface of said sheet holding body;

an ink sheet having a plurality of color material layers, each layer containing an ink material;

recording means which selectively records the ink material on said dye depositing layer while keeping said intermediate sheet sticking fast on the surface of said sheet holding body; and transcription means to transcribe said ink material recorded in said intermediate sheet on to a recording sheet together with said dye depositing layer of said intermediate sheet while keeping said surface of intermediate sheet carrying the recorded ink material touching said recording sheet; wherein, a width of said sheet holding body, a width of said ink sheet and a width of said recording sheet are larger than a width of said intermediate sheet.

2. A color image recording apparatus according to claim 1, wherein, said means to hold a second surface of said intermediate sheet to the sticky surface of said sheet holding body is a pressing roller;

said pressing roller is at least one of upstream and downstream of the recording means in order to hold the ink sheet to the sticky surface of the sheet holding body;

a width of said pressing roller is larger than a width of said intermediate sheet; and said ink sheet is larger than the width of said intermediate sheet.

3. A color image recording apparatus comprising:

an intermediate sheet made of a continuous substrate sheet having a transparent dye depositing layer on a first surface of said intermediate sheet;

a sheet holding body having a sticky surface;

a pressing roller to hold a second surface of said intermediate sheet to the sticky surface of said sheet holding body;

an ink sheet having a plurality of color material layers, each layer containing an ink material;

recording means which selectively records the ink material on said dye depositing layer while maintaining said intermediate sheet sticking fast to the surface of said sheet holding body; and transcription means to transcribe said ink material recorded in said intermediate sheet on to a recording sheet together with said dye depositing layer of said intermediate sheet while maintaining said first surface of intermediate sheet carrying the ink material in contact with said recording sheet; wherein, said pressing roller is at least one of upstream and downstream of the recording means in order to hold the ink sheet on the intermediate sheet; and a width of said pressing roller is larger than a width of said intermediate sheet, a width of said sheet holding body is larger than the width of said intermediate sheet, and a width of said ink sheet is smaller than the width of said intermediate sheet.

4. A color image recording apparatus comprising:

an intermediate sheet made of a continuous substrate sheet having a transparent dye depositing layer on one of the surfaces;

a recording means which selectively records an image on said dye depositing layer;

a transcription means which transcribes said dye depositing layer of intermediate sheet having a recorded image on to the recording sheet by heat•pressing said dye depositing layer touching the recording sheet; and a separation means to separate said recording sheet from said intermediate sheet; wherein, said separation means is shaped to have an extrusion in its middle part against both sides.

5. A color image recording apparatus according to claim 4, wherein, the separation means is equipped with an auxiliary separation means which touches to the recording sheet at the separation position from the same side as said recording sheet, and the auxiliary separation means is constituted to touch to said dye depositing layer from the same side as said recording sheet along the side edges of said recording sheet.

6. A color image recording apparatus according to claim 5, wherein, a transfer means is equipped to carry the separated recording sheet; where, the transfer speed of recording sheet is made faster relative to that of intermediate sheet at least during a moment immediately before/after the rear end of said recording sheet passes through the separation means.

7. A color image recording apparatus according to claim 4, wherein, a transfer means is equipped to carry the separated recording sheet; where, the transfer speed of recording sheet is made faster relative to that of intermediate sheet at least during a moment immediately before/after the rear end of said recording sheet passes through the separation means.

8. A process for recording a color image on a first surface of an intermediate sheet, the process comprising the steps of:

holding a second surface of the intermediate sheet to a sticky surface of a sheet holding body;

recording an ink material onto a dye depositing layer of the intermediate sheet while maintaining the second surface of the intermediate sheet on the surface of the sheet holding body;

forming a color image by repeatedly multi-color recording while holding the intermediate sheet on the sheet holding body and releasing said intermediate sheet from the condition of holding, the color image having a length longer than the sheet holding body can hold at one time;

transcribing the ink material recorded in the intermediate sheet to a recording sheet together with the dye depositing layer of the intermediate sheet by contacting the first surface of intermediate sheet carrying the ink material with the recording sheet; and separating the substrate of the intermediate sheet from the recording sheet and the dye depositing layer after transcription.

* * * * *